US010690439B1

(12) United States Patent
Gillett

(10) Patent No.: US 10,690,439 B1
(45) Date of Patent: Jun. 23, 2020

(54) EMBEDDED CORD SELF-DEFENSE SYSTEM WITH GARMENT ASSEMBLY

(71) Applicant: Timothy Gillett, Tiverton, RI (US)

(72) Inventor: Timothy Gillett, Tiverton, RI (US)

( * ) Notice: Subject to any disclaimer, the term of this patent is extended or adjusted under 35 U.S.C. 154(b) by 0 days.

(21) Appl. No.: 15/932,010

(22) Filed: Jan. 24, 2018

(51) Int. Cl.
*A41D 27/00* (2006.01)
*F41B 15/00* (2006.01)
*F41H 1/02* (2006.01)

(52) U.S. Cl.
CPC ..... *F41B 15/00* (2013.01); *A41D 27/00* (2013.01); *F41H 1/02* (2013.01)

(58) Field of Classification Search
CPC .... A41B 15/00; A41D 27/00; A41D 13/0012; A41D 13/0002
USPC ..... 2/94, 247
See application file for complete search history.

(56) References Cited

U.S. PATENT DOCUMENTS 3,074,074 A * 1/1963 Lovering ..... A01M 31/00 2/94
3,561,394 A * 2/1971 Pickens ..... A41D 13/01 116/35 R
4,706,858 A * 11/1987 Whatley ..... A01M 31/00 2/94
5,186,701 A * 2/1993 Wilkinson ..... A41D 13/0015 482/121
5,306,222 A * 4/1994 Wilkinson ..... A41D 13/0015 482/121
5,802,609 A * 9/1998 Garofalo ..... A41D 13/0005 2/2.15
5,839,122 A * 11/1998 Dicker ..... A41D 7/00 2/67
5,875,491 A * 3/1999 Wilkinson ..... A41D 13/0015 2/227
6,525,662 B1 * 2/2003 Ford ..... A41D 1/005 340/539.1
6,922,149 B1 * 7/2005 Ford ..... A41D 1/005 340/539.1
9,242,093 B1 * 1/2016 Sherman ..... A41D 27/205
2007/0044366 A1 * 3/2007 Walko ..... A01K 97/10 43/21.2
2007/0214707 A1 * 9/2007 Walko ..... A01K 97/10 43/21.2
2008/0246326 A1 * 10/2008 Lichtner ..... A47D 15/006 297/465
2010/0235957 A1 * 9/2010 Dovner ..... F41H 1/02 2/2.5
2012/0201412 A1 * 8/2012 Del Prete ..... H04R 1/1033 381/374
2013/0139287 A1 * 6/2013 Dovner ..... F41H 1/02 2/2.5
2013/0318680 A1 * 12/2013 Keathley ..... A41D 3/00 2/94
2014/0112521 A1 * 4/2014 Wolfe ..... H04R 1/1033 381/384

(Continued)

*Primary Examiner* — Gloria M Hale
(74) *Attorney, Agent, or Firm* — Frank L. Kubler

(57) ABSTRACT

A self-defense garment assembly is further provided, including a garment for covering at least the body of a wearer having a garment interior surface; a cord retaining guide structure extending substantially within the garment along the garment interior surface; and a pull cord having a cord first end and a cord second end which is slidably retained within the cord retaining guide structure; so that at least a segment of the cord can be pulled out of the garment and used to fight a combat opponent.

11 Claims, 2 Drawing Sheets

(56) References Cited

U.S. PATENT DOCUMENTS

2016/0374407 A1* 12/2016 Yagerman ..... A41D 13/0012
2/411

* cited by examiner

EMBEDDED CORD SELF-DEFENSE SYSTEM WITH GARMENT ASSEMBLY

BACKGROUND OF THE INVENTION

1. Field of the Invention

The present invention relates generally to the fields of garments and combat weapons, such as martial arts weapons. More specifically the present invention relates a garment assembly including a garment, which is understood to be any type of garment, such as but not limited to a coat, jacket, shirt, pants or a dress, and which contains a concealed pull cord and cord retaining guide means, permitting the wearer of the garment to draw at least part of the cord from the garment to surprise and restrain a combat opponent such as for self-defense. The preferred garment assembly includes a sleeved outer garment for covering at least the upper body of a wearer having a garment front portion and a garment back portion interconnected at garment sides and at the top of the garment on either side of a neck opening defining first and second garment shoulder portions, a full length first sleeve having a first sleeve connected end and a first sleeve free end and a full length second sleeve having a second sleeve connected end and a second sleeve free end, and further including a cord retaining guide means extending substantially from the first sleeve free end longitudinally along and connected to a first sleeve, along the garment back portion along the first and second shoulder portions and longitudinally along and connected to the second sleeve substantially to the second sleeve free end, and a pull cord having a cord first end and a cord second end which is slidably retained within the cord retaining guide means and is of sufficient length to extend from the first sleeve free end and along the full length of the guide means to the second sleeve free end. In this way the pull cord is said to be embedded in the garment. Multiple pull cords and corresponding cord retaining guide means may be provided in a single garment.

The garment optionally may be a shirt, a coat or a jacket and optionally includes a collar or a hood. The cord preferably has a first gripping loop formed at the cord first end and optionally has a second gripping loop formed at the cord second end, the first and second gripping loops preferably being sized in diameter to fit easily and preferably closely over and around only a human thumb.

The cord retaining guide means preferably extends along and is secured relative to the inward or interior surfaces of the garment along the path described above so that the guide means and the cord remain concealed until the cord is accessed and used. The cord retaining guide means preferably includes a spaced apart series of annular guide structures secured to the garment which are preferably tubular fabric sheathes open at both sheath ends.

When needed as a weapon for combat, user thumbs may be fitted through both the first and second gripping loops and a length of the pull cord is pulled forwardly out of the sleeve and this segment of the pull cord is used as a weapon capable of restraining and binding an opponent, surprising an opponent who until that moment did not know the wearer had a cord. Alternatively, a user thumb is fitted through the first gripping loop to pull the pull cord entirely out of the pull cord retaining guide means.

2. Description of the Prior Art

There have long been flexible cords, chains or links for use as weapons in a variety of different forms of combat, and particularly in several of the martial arts. Yet it can be impractical in civilian life to carry such an item around on a day to day basis to be prepared for physical combat.

It is thus an object of the present invention to provide a long sleeve self-defense garment assembly containing a pull cord slidably retained within cord retaining guide means and extending to the free ends of the garment sleeves to be gripped and rapidly pulled out partly out of and alternatively all the way out of the garment at least one of the sleeves and swung around the neck, an arm or other body part of an opponent to restrain, bind, or otherwise subdue the opponent, and in general providing all of the combat advantages that any rope would give. The garment may include multiple, separate pull cords, each with its own corresponding cord retaining guide means.

It is another object of the present invention to provide such a garment assembly in which the cord and cord retaining guide means are concealed within the garment, so that the cord becomes visible only at the very moment deployed by the wearer, and thus gives the wearer the advantage of complete surprise.

It is still another object of the present invention to provide such a garment assembly which functions as a non-lethal weapon for both offensive and defensive combat which can be deployed quickly and therefore eliminate the need of reaching into a pocket and fumbling for a weapon, and can quickly restrain, intercept and deflect blows and deter an attack.

It is yet another object of the present invention to provide such a garment assembly which does not inhibit the movement of the wearer, and in which the cord is carried and securely retained and immediately ready for use simply by wearing the garment.

It is finally an object of the present invention to provide such a garment assembly which lends itself to many forms of combat and which is simple, durable, reliable, reusable and inexpensive to manufacture.

SUMMARY OF THE INVENTION

The present invention accomplishes the above-stated objectives, as well as others, as may be determined by a fair reading and interpretation of the entire specification.

A self-defense garment assembly is provided preferably including a sleeved outer garment for covering at least the upper body of a wearer having a garment interior surface and having a neck opening and a garment front portion and a garment back portion interconnected at garment sides and at the top of the garment on either side of the neck opening defining a first garment shoulder portion and a second garment shoulder portion, a substantially full length first sleeve having a first sleeve connected end and a first sleeve free end and a substantially full length second sleeve having a second sleeve connected end and a second sleeve free end; a cord retaining guide structure extending substantially from the first sleeve free end longitudinally along and connected to a first sleeve, along the garment back portion along the first shoulder portion and the second shoulder portion and longitudinally along and connected to the second sleeve substantially to the second sleeve free end; and a pull cord having a cord first end and a cord second end which is slidably retained within the cord retaining guide structure and is of sufficient length to extend from at least the first sleeve free end and along substantially the full length of the cord retaining guide structure substantially to the second sleeve free end; so that at least a segment of the cord can be pulled out of the garment and used to fight a combat opponent.

The garment can be any type of garment, including but not limited to a shirt, a coat and a jacket, and the garment optionally includes a collar or a hood.

The cord retaining guide structure preferably extends along and is secured relative to the garment interior surface; so that the cord retaining guide structure and the cord remain concealed within the garment until the cord is accessed by the wearer and used. The cord preferably additionally includes a first gripping loop formed at the cord first end. The cord preferably still additionally includes a second gripping loop formed at the cord second end, the first and second gripping loops being sized in diameter to fit over and around a human thumb.

The cord retaining guide structure preferably includes a spaced apart series of annular guide structures secured to the garment. The annular guide structures preferably include tubular fabric sheathes open at both sheath ends. The cord preferably is flat stock cord, but may be formed of any sufficiently durable material including but not limited to metal such as steel, nylon, Kevlar™, tweed and paracord.

A self-defense garment assembly is further provided, including a garment for covering at least the body of a wearer having a garment interior surface; a cord retaining guide structure extending substantially within the garment along the garment interior surface; and a pull cord having a cord first end and a cord second end which is slidably retained within the cord retaining guide structure; so that at least a segment of the cord can be pulled out of the garment and used to fight a combat opponent or for any other desired purpose, including but not limited to non-combat uses such as a sex toy.

BRIEF DESCRIPTION OF THE DRAWINGS

Various other objects, advantages, and features of the invention will become apparent to those skilled in the art from the following discussion taken in conjunction with the following drawings, in which.

DETAILED DESCRIPTION OF THE PREFERRED EMBODIMENTS

Figure 1:
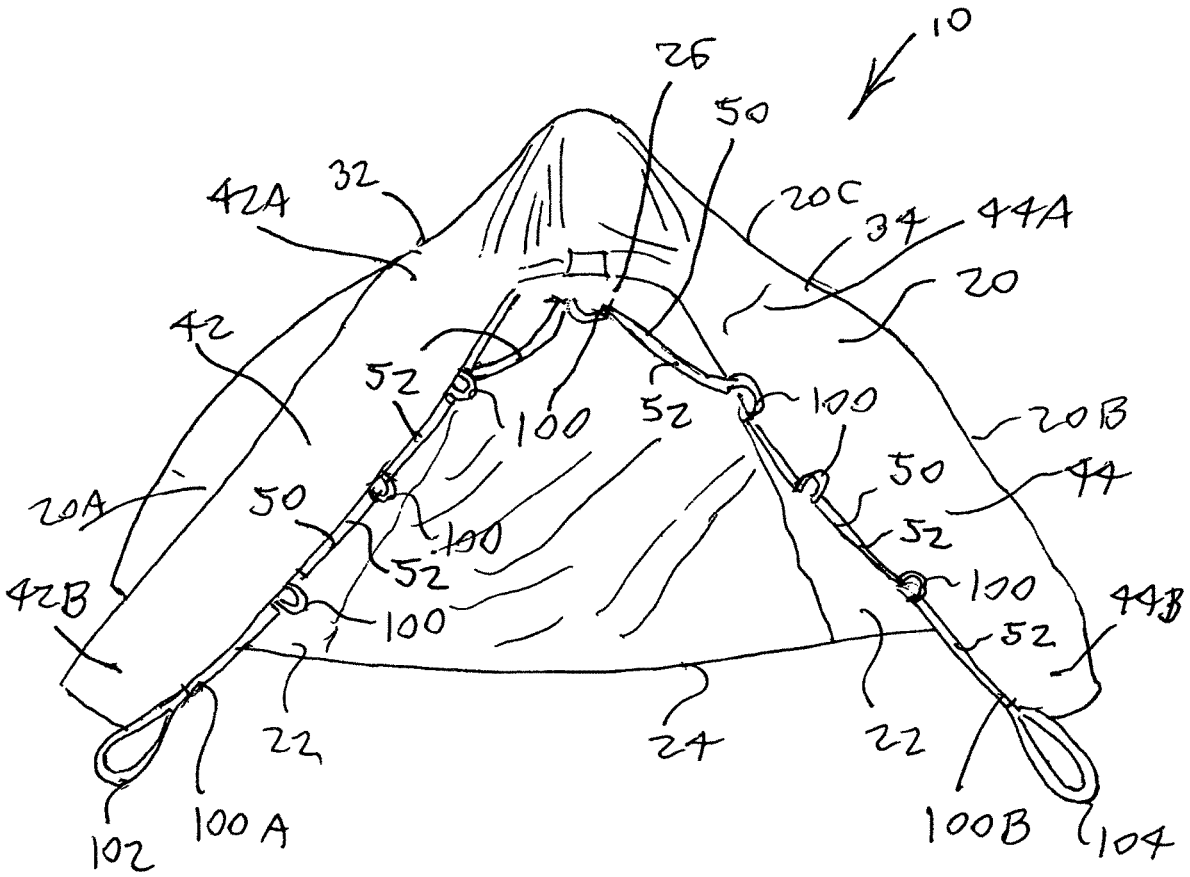
FIG. 1 is a front view of a the preferred embodiment of the garment assembly showing a jacket turned inside out to reveal the cord retaining guide means and the pull cord itself equipped with gripping loops at each end.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various FIGURES are designated by the same reference numerals.

First Preferred Embodiment

Figure 2:
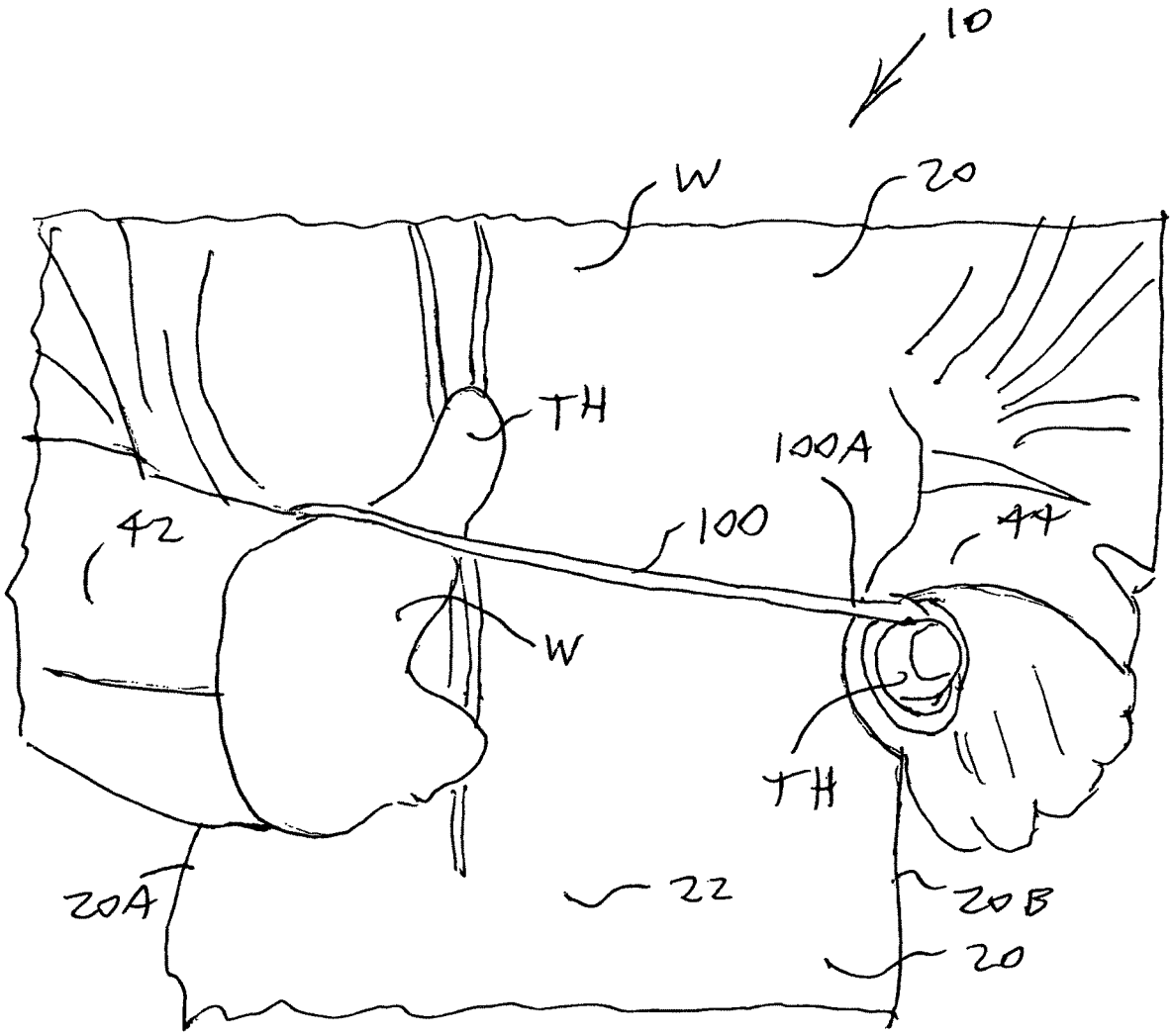
FIG. 2 is a front perspective view of a the torso of a person wearing the garment assembly of FIG. 1 with one of the gripping loops and a segment of the pull cord pulled out from a sleeve so that the pull cord is deployed for use in combat.

Referring to FIGS. 1-2, a garment assembly 10 is disclosed including a garment 20 which preferably, although not necessarily, is a sleeved outer garment for covering at least the upper body of a wearer W having a garment front portion 22 and a garment back portion 24 interconnected at garment sides 20A and 20B and at the garment top 20C on either side of a neck opening 26 defining a first shoulder portion 32 and a second garment shoulder portion 34, a full length first sleeve 42 having a first sleeve connected end 42A and a first sleeve free end 42B and a full length second sleeve 44 having a second sleeve connected end 44A and a second sleeve free end 44B, and further including a cord retaining guide means 50 extending substantially from the first sleeve free end 42B longitudinally along and connected to a first sleeve 42, along the garment back portion 24 along the first and second shoulder portions 32 and 34 and longitudinally along and connected to the second sleeve 44 substantially to the second sleeve free end 44B, and a pull cord 100 having a cord first end 100A and a cord second end 100B which is slidably retained within the cord retaining guide means 50 and is of sufficient length to extend from the first sleeve free end 42A and along the full length of the guide means 50 to the second sleeve free end 44B. It is contemplated that extra cord beyond this length may be provided, but in most instances would not be. In this way the pull cord 100 is said to be embedded in the garment 20. It is contemplated that multiple pull cords 100 may be included as part of the garment 20 and thus of garment assembly 10, together with corresponding cord retaining guide means 50. The garment 20, as noted above, may be any garment including but not limited to a shirt, a coat, a jacket, pants, a dress, a boot, a belt, a vest or a tactical body suit and optionally includes a collar 110 or a hood 120. The cord retaining guide means 50 preferably extends along and is secured relative to the inward or interior surfaces IS of the garment 20 preferably along the path described above so that the guide means 50 and the cord 100 remain concealed until the cord 100 is accessed and used. For all types of garment 20, the cord 100 retaining guide means 50 preferably is positioned within the garment 20 to place the cord first end 100A and cord second end 100B where they can be easily and most quickly reached.

The cord 100 preferably has a first gripping loop 102 formed at the cord first end 100A and optionally has a second gripping loop 104 formed at the cord second end 100B, the first and second gripping loops 102 and 104 preferably being sized in diameter to fit easily and preferably closely over and around only a human thumb TH. The cord retaining guide means 50 preferably includes a spaced apart series of annular guide structures 52 secured to the garment 20 which are preferably tubular fabric sheathes open at both ends. The cord 100 itself preferably is custom cut to suit a particular wearer W body size and is of sufficient length that the gripping loops remain tucked inside garment sleeves, if it is a garment 20 that has sleeves. The cord 100 may be formed of any suitably strong and durable material, and for one embodiment is black, flat stock cord to be inconspicuous and easy to conceal. Examples of contemplated cord 100 materials include but are not limited to metal, such as steel, nylon, Kevlar™, tweed or paracord. The garment 20 can be formed of any of a wide variety of appropriate materials, depending on the type of garment 20, such as a sweatshirt, vinyl jacket or leather jacket, but since the garment 20 is to be worn during in hand to hand combat the material from which it is made should be rugged and highly durable. Other types of garments 20 are contemplated for use as part of the present garment assembly 10, including but not limited to pants and dresses.

Method

In practicing the invention, the following method may be used. When needed as a weapon for combat, user thumbs TH may be fitted through both the first and second gripping loops 102 and 104 and a segment S of the pull cord 100 is pulled forwardly out of the sleeve 42 or 44 and this segment S of the cord 100 is used as a weapon capable of restraining and binding an opponent and deflecting blows, surprising an opponent who until that moment did not know the wearer had a cord. Alternatively, a user thumb TH is fitted through the first gripping loop 102 to pull the pull cord 100 entirely out of the pull cord retaining guide means 50. Either way, cord 100 can be fitted around the neck, around a limb or over a digit of the opponent so that he or she can be swiftly subdued, pinned or otherwise disabled as necessary for the self-preservation of the wearer W. The binding capability of the pull cord 100 may also be used for many purposes other than combat.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim as my invention:

1. A self-defense garment assembly, comprising:

a sleeved outer garment for covering at least an upper body of a wearer having a garment interior surface and having a neck opening and a garment front portion and a garment back portion interconnected at garment sides and at the top of said garment on either side of said neck opening defining a first garment shoulder portion and a second garment shoulder portion, a substantially full length first sleeve having a first sleeve connected end and a first sleeve free end and a substantially full length second sleeve having a second sleeve connected end and a second sleeve free end;

a cord retaining guide means extending substantially from said first sleeve free end longitudinally along and connected to a first sleeve, along the garment back portion along said first shoulder portion and said second shoulder portion and longitudinally along and connected to said second sleeve substantially to said second sleeve free end;

and a pull cord having a cord first end and a cord second end which is slidably retained within said cord retaining guide means and extends from at least said first sleeve free end and along said cord retaining guide means substantially to said second sleeve free end;

wherein said cord additionally comprises a first gripping loop formed at said cord first end;

such that said gripping loop is able to be gripped by a wearer and at least a segment of said cord is able to be pulled out of said garment and used to fight a combat opponent.

2. The garment assembly of claim 1, wherein said garment is one of a shirt, a coat and a jacket.

3. The garment assembly of claim 1, wherein said garment comprises at least one of a collar and a hood.

4. The garment assembly of claim 1, wherein said cord retaining guide means extends along and is secured relative to said garment interior surface;

such that said cord retaining guide means and said cord remain concealed within said garment until said cord is accessed by the wearer and used.

5. The garment assembly of claim 1, wherein said cord is formed of substantially nonelastic material.

6. The garment assembly of claim 5, wherein said cord additionally comprises a second gripping loop formed at said cord second end, said first and second gripping loops being sized in diameter to fit over and around a human thumb.

7. The garment assembly of claim 1, wherein said cord retaining guide means comprises a spaced apart series of annular guide structures secured to said garment.

8. The garment assembly of claim 7, wherein said annular guide structures comprise tubular fabric sheathes open at both sheath ends.

9. The garment assembly of claim 1, wherein said cord is flat stock cord.

10. A self-defense garment assembly, comprising:

a garment for covering at least a wearer body having a garment interior surface;

a cord retaining guide means extending substantially within said garment along said garment interior surface;

and a pull cord having a cord first end and a cord second end which is slidably retained within said cord retaining guide means;

such that at least a segment of said cord is able to be pulled out of said garment and used to fight a combat opponent.

11. The garment assembly of claim 1, wherein said cord additionally comprises a second gripping loop formed at said cord second end.

* * * * *